US011320149B2

(12) United States Patent
Dobias

(10) Patent No.: US 11,320,149 B2
(45) Date of Patent: May 3, 2022

(54) DUAL HEAT FIRE PIT

(71) Applicant: Mr. Bar-B-Q Products LLC, Melville, NY (US)

(72) Inventor: Scott F. Dobias, Winston-Salem, NC (US)

(73) Assignee: MR. BAR-B-Q PRODUCTS LLC, Hauppauge, NY (US)

( * ) Notice: Subject to any disclaimer, the term of this patent is extended or adjusted under 35 U.S.C. 154(b) by 139 days.

(21) Appl. No.: 16/891,736

(22) Filed: Jun. 3, 2020

(65) Prior Publication Data

US 2020/0292175 A1 Sep. 17, 2020

Related U.S. Application Data

(63) Continuation of application No. 16/317,398, filed as application No. PCT/US2017/042176 on Jul. 14, 2017, now Pat. No. 10,684,020.

(60) Provisional application No. 62/362,489, filed on Jul. 14, 2016.

(51) Int. Cl.

| | |
|---|---|
| ***F24C 1/04*** | (2021.01) |
| ***F24C 3/04*** | (2021.01) |
| ***F24C 5/08*** | (2021.01) |
| ***F24C 7/04*** | (2021.01) |
| ***F24C 7/10*** | (2021.01) |
| ***F24C 15/08*** | (2006.01) |

(52) U.S. Cl.

CPC ..... *F24C 1/04* (2013.01); *F24C 3/047* (2013.01); *F24C 5/08* (2013.01); *F24C 7/046* (2013.01); *F24C 7/10* (2013.01); *F24C 15/08* (2013.01)

(58) Field of Classification Search

CPC ..... F24C 5/08; F24C 7/10; F24C 1/04; F24C 7/046; F24C 15/08; F24C 3/047

See application file for complete search history.

(56) References Cited

U.S. PATENT DOCUMENTS

| | | | | |
|---|---|---|---|---|
| 3,424,146 | A | 1/1969 | Patrick et al. | |
| 4,340,028 | A | 7/1982 | Hatta et al. | |
| 9,329,606 | B2 | 5/2016 | Barkhouse et al. | |
| 2004/0231659 | A1 | 11/2004 | Schlosser et al. | |
| 2006/0266351 | A1 | 11/2006 | Griffin | |
| 2007/0204858 | A1* | 9/2007 | Abelbeck | F24C 3/12 126/41 R |
| 2009/0202688 | A1 | 8/2009 | Best | |

OTHER PUBLICATIONS

International Search Report issued in PCT Application No. PCT/US2017/042176 dated Sep. 13, 2017.

Office Action issued by the Canadian Intellectual Property Office in corresponding Canadian Patent Application No. 3,009,849 dated Jul. 11, 2019.

* cited by examiner

*Primary Examiner* — Alfred Basichas

(74) *Attorney, Agent, or Firm* — Carter, DeLuca & Farrell LLP

(57) ABSTRACT

The present disclosure is directed to a multi-heat source apparatus. The multi heat source may include a fire pit and is configured to provide ambient heating with both convection heat transfer and radiation heat transfer. The multi-heat source apparatus comprises an infrared emitter for generating infrared radiation. The multi-heat source apparatus comprises a shielding member between a heat source for the convection heat transfer and another heat source for radiation heat transfer.

19 Claims, 6 Drawing Sheets

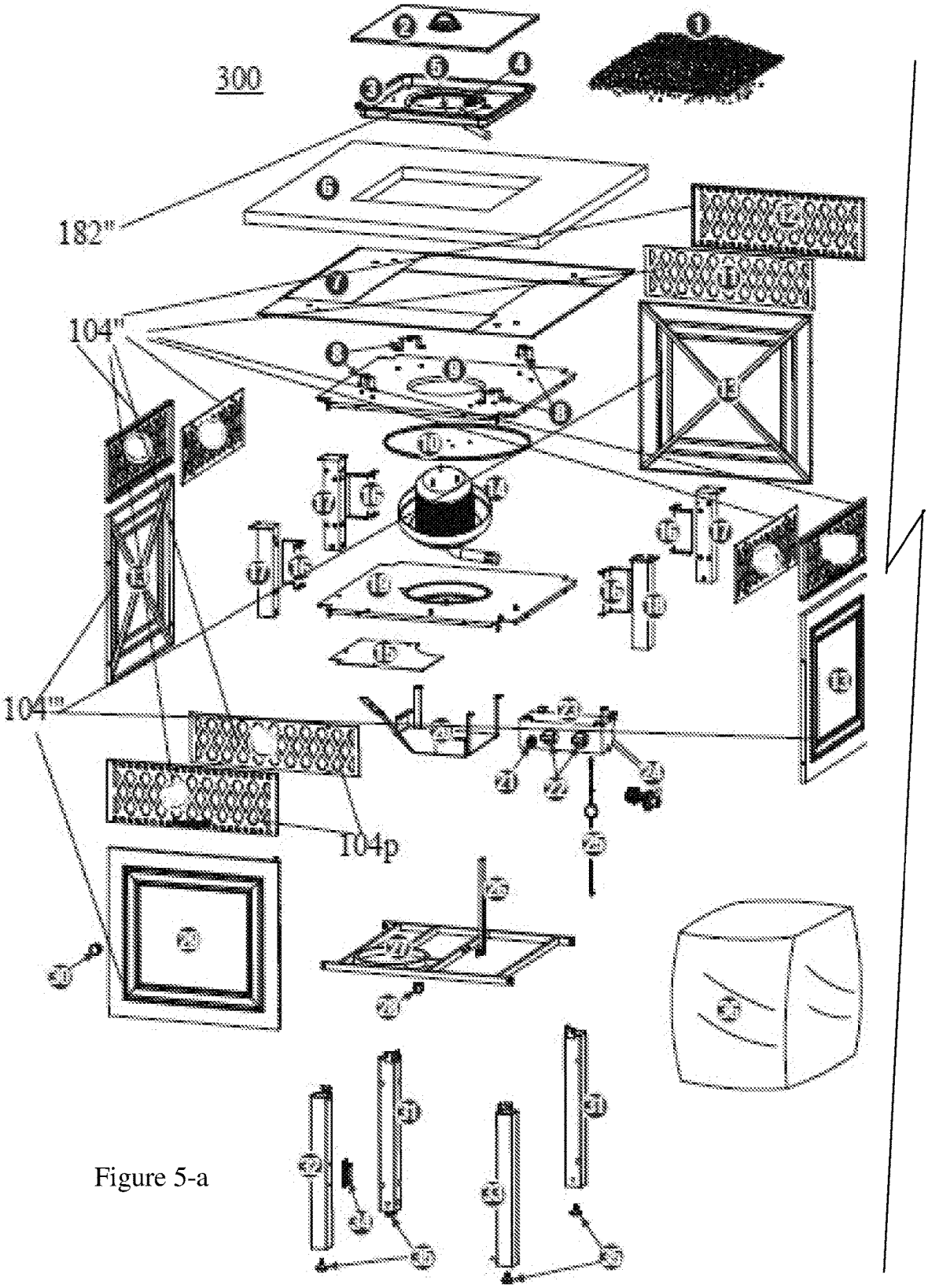
Figure 5-a

| | |
|---|---|
| 1 | Bronze Fire Glass |
| 2 | Table Insert |
| 3 | Firebowl Assembly* |
| 4 | Igniter Cover* |
| 182" | Burner* |
| 6 | Mantel* |
| 7 | Heat Shield A* |
| 8 | Support Brackets* |
| 9 | Heat Shield B* |
| 10 | Dome* |
| 13 | Lower Panel (3) |
| 14 | Lower Burner Assembly* |
| 15 | Heat Shield C* |
| 16 | Side Heat Shield Bracket (4)* |
| 17 | Upper Post (3)* |
| 18 | Upper Post B* |
| 19 | Lower Heat Shield* |
| 20 | LP Gas Tank Heat Shield* |
| 21 | Battery Cap* |
| 22 | Control Knob (2)* |
| 23 | Control Panel Assembly* |

| | |
|---|---|
| 22 | Control Knob (2)* |
| 23 | Control Panel Assembly* |
| 24 | Regulator Hose Assembly* |
| 25 | Lighting Hook |
| 26 | LP Gas Tank Prevent Bar |
| 27 | Base* |
| 28 | LP Gas Tank Retainer Bolt* |
| 29 | Door* |
| 30 | Door Knob* |
| 31 | Leg A (2) |
| 32 | Leg B |
| 33 | Leg C |
| 34 | Magnet* |
| 35 | Foot (4)* |
| 36 | Cover |

Figure 5-b

DUAL HEAT FIRE PIT

CROSS-REFERENCE TO RELATED APPLICATIONS

This application is a continuation of U.S. Pat. No. 10,684,020, filed Jan. 11, 2019, which is a national stage application of PCT/US2017/042176, filed Jul. 14, 2017, which claims the benefit of and priority to U.S. Provisional Patent Application No. 62/362,489, filed Jul. 14, 2016, the entire contents of each of which is hereby incorporated by reference in their entirety.

TECHNICAL FIELD

This disclosure relates to a multi-heat source apparatus and, more particularly, relates to a multi-heat source fire pit apparatus.

BACKGROUND

Conventional fire pits have been in use for many years and are designed to sustain flames for heating and ornamental purposes and for the purposes of containing a fire and preventing it from spreading. In general, fire pits provide warmth and ambience and are most often used outdoors, such as in outdoor patio areas. Fire pits are available in both built-in configurations, e.g., physically mounted or secured in or to the ground, and free-standing configurations, e.g., a portable fire pit constructed from a ceramic material, such as stone or brick, metal or other material, that can be placed by the user in a desired location. Conventional fire pits are typically fueled by natural gas, propane, or bioethanol, and in some instances wood burning fire pits are also utilized.

Conventional fire pits are typically configured to provide open flames by burning propane received from a propane tank, for heating the surroundings. These flames typically disseminate heat or thermal energy, predominantly, only by conduction heat transfer and/or convention heat transfer. Specifically, conventional fire pits transfer thermal energy to objects in contact with the flame by conduction heat transfer, via microscopic movement of electrons, and transfer thermal energy to the surroundings by convection heat transfer, via heat diffusion and bulk movement of the surrounding air. As such, since conventional fire pits require a medium, such as air, for heat transfer, the intensity, area and direction of the propagation of heat is constrained and influenced by the properties of the medium. In this regard, conventional fire pit provide the higher temperature/heating in regions proximate to the heat source (flame) with a gradual decrease in temperature/heat intensity in regions away from the source. This progressive reduction in heat intensity and/or temperature, as a function of the distance away from the heat source, is typically affected by energy dissipation and unavoidable losses in the surrounding air and atmosphere. For example, even though the flame heat source is at a predetermined temperature, surrounding cold air would lessen the heat or temperature perceived by a user in the vicinity to greatly below the predetermined temperature, due to factors like wind, diffusion and attaining thermal equilibrium. Furthermore, it is often challenging to focus the heat provided by such convection heat transfers of open flames to a desired area.

The present disclosure alleviates the foregoing drawbacks and provides an improvement to existing fire pits by providing a fire pit with multiple modes of heat transfer.

SUMMARY

The following presents a simplified summary of one or more embodiments of the disclosure in order to provide a basic understanding of such embodiments. This summary is not an extensive overview of all contemplated embodiments, and is intended to neither identify key or critical elements of all embodiments, nor delineate the scope of any or all embodiments. Its sole purpose is to present some concepts of one or more embodiments in a simplified form as a prelude to the more detailed description that is presented later.

Embodiments of the disclosure are directed to a multi-heat source apparatus. A multi-heat source apparatus of the present disclosure includes a housing configured to form a first compartment and a second compartment, wherein the first compartment is configured to receive a fuel source and the second compartment is configured to receive a first heat source configured to produce ambient heating; and a second heat source positioned on the housing and configured to produce heat by fuel received from the fuel source, wherein the housing includes one or more apertures structured to allow propagation of heat emitted from the first heat source.

The disclosure is directed to a multi-heat source fire pit apparatus. The multi-heat source fire pit apparatus includes a fire pit housing having a planar member with lateral side members extending vertically from the planar member, the planar member defining opposing first and second lateral ends in a first direction and a proximal end and an opposing distal end in a direction transverse to the first direction, the planar member with the lateral side members forming a first compartment and a second compartment; a first heat source configured to produce ambient heating positioned in at least one of the first and second compartments; and a second heat source positioned within the planar member, wherein the lateral side members include one or more apertures structured to allow propagation of the ambient heating emitted from the first heat source.

The disclosure provides a fire pit apparatus comprising a fire pit housing having a planar member having lateral side members configured to form at least one compartment configured to receive a fuel source; a first heat source configured to produce ambient heating and positioned in the at least one compartment; and a second heat source positioned on the planar member of the fire pit housing and configured to produce heat from the fuel source, wherein the lateral side members are positioned proximate at least the first heat source, and wherein the lateral side members include one or more apertures structured to allow propagation of heat emitted from the first hat source.

In other embodiments, a multi-heat source fire pit apparatus is provided which includes a fire pit housing having a planar top surface having vertical side members to form a storage area configured to receive a fuel source; a first heat source configured to produce ambient heating and positioned in the storage area and configured to emit heat or radiation; and a second heat source positioned above the storage area on the planar top surface and configured to produce heat by fuel received from the fuel source, wherein the vertical side members are positioned proximate the first heat source, and wherein the vertical side members include one or more apertures structured to allow propagation of heat emitted from the first heat source.

The disclosure generally embodies a fire pit apparatus comprising a fire pit housing. The fire pit housing typically comprises one or more compartments. In one embodiment, the fire pit housing comprises a first compartment and an adjacent second compartment. The first compartment is structured to receive the fuel tank. An infrared (IR) emitter that is structured to emit IR radiation is positioned in the second compartment. In some embodiments, a burner assembly may be positioned, for example above at least a portion of the second compartment or at any other suitable location on the fire pit housing. The burner assembly is structured to produce an open flame, for example, by combusting fuel received from the fuel tank. In some embodiments, or in combination with the embodiment described above, the fire pit housing comprises a first shielding member between the burner assembly and the second compartment. The first shielding member is structured to at least partially shield the burner assembly from IR radiation emitted by the IR emitter. The first shielding member is structured to inhibit, partially or fully, IR radiation emitted by the IR emitter from propagating therethrough. In some embodiments, or in combination with any of the embodiments described above, the fire pit housing comprises a second shielding member between the first compartment and the second compartment. The second shielding member is structured to inhibit IR radiation emitted by the IR emitter from propagating therethrough, and hence shield the first compartment and the fuel tank from the IR radiation. In some embodiments, or in combination with the embodiment described above, the fire pit housing comprises a third shielding member that is arranged opposite the first shielding member. The third shielding member is typically structured to inhibit IR radiation emitted by the IR emitter from propagating therethrough.

In some embodiments, or in combination with any of the above embodiments, the burner assembly provides convection heat transfer (e.g., via the air surrounding the fire pit apparatus) and/or conduction heat transfer (e.g., via adjacent thermally conducting surfaces).

In some embodiments, or in combination with any of the above embodiments, the fire pit housing comprises a lateral side member positioned proximate the IR emitter. The lateral side member may comprise one or more apertures structured to allow propagation of IR radiation emitted from the IR emitter.

In some embodiments, or in combination with any of the above embodiments, the first, second and/or third shielding members comprise a reflective coating on a surface proximate to the IR emitter. This reflective coating is structured to reflect incident IR radiation from the IR emitter into the second compartment. In some embodiments, the reflective coating has a reflectance of 0.9 to 1, for example, to reflect substantially all the incident radiation from the IR emitter.

In some embodiments, or in combination with any of the above embodiments, the IR emitter is structured to produce a first ambient temperature at a predetermined location at a first distance away from the fire pit apparatus. The first ambient temperature is the temperature produced at the predetermined location if the IR emitter were the sole heating source. In one embodiment, the first ambient temperature is greater than or equal to a second ambient temperature produced by convection heat transfer from the burner assembly at the predetermined location, wherein the second ambient temperature is the temperature produced at the predetermined location at the first distance away if the convection heat transfer was the sole In some embodiments, or in combination with any of the above embodiments, the IR emitter comprises a filament and a concave trough.

In some embodiments, or in combination with any of the above embodiments, the IR emitter is configured to convert electrical energy into IR radiation.

In some embodiments, or in combination with any of the above embodiments, the IR emitter is configured to convert energy from fuel in the fuel tank into IR radiation.

In some embodiments, or in combination with any of the above embodiments, the fire pit housing is structured to inhibit propagation of IR radiation from the IR emitter along first, second and third inhibiting directions. The third direction is approximately 180 degrees relative to the first direction. The second direction is approximately 90 degrees relative to the first and third directions.

In some embodiments, or in combination with any of the above embodiments, the IR emitter is a directional IR emitter that is structured to inhibit propagation of IR radiation in at least one direction.

In some embodiments, or in combination with any of the above embodiments, the directional IR emitter comprises a shielding cover structured to inhibit propagation of IR radiation in at least one direction.

In some embodiments, or in combination with any of the above embodiments, the directional IR emitter is structured to inhibit propagation of IR radiation in a first direction extending towards the burner assembly.

In some embodiments, or in combination with any of the above embodiments, the directional IR emitter is structured to inhibit propagation of IR radiation in a second direction extending towards the fuel tank.

In some embodiments, or in combination with any of the above embodiments, the directional IR emitter is structured to focus the emitted IR radiation in a single heating direction.

Unless otherwise defined, all technical and scientific terms used herein have the same meaning as commonly understood by one of ordinary skill in the art to which this disclosure belongs. Although methods and materials similar, or equivalent to those described herein can be used in the practice or testing of the present disclosure, suitable methods and materials are described below. In case of conflict, the patent specification, including definitions, will control. In addition, the materials, methods, and examples are illustrative only and are not intended to be The features, functions, and advantages that have been discussed may be achieved independently in various embodiments of the present disclosure or may be combined with yet other embodiments, further details of which can be seen with reference to the following description and drawings.

BRIEF DESCRIPTION OF THE DRAWINGS

Figure 1:
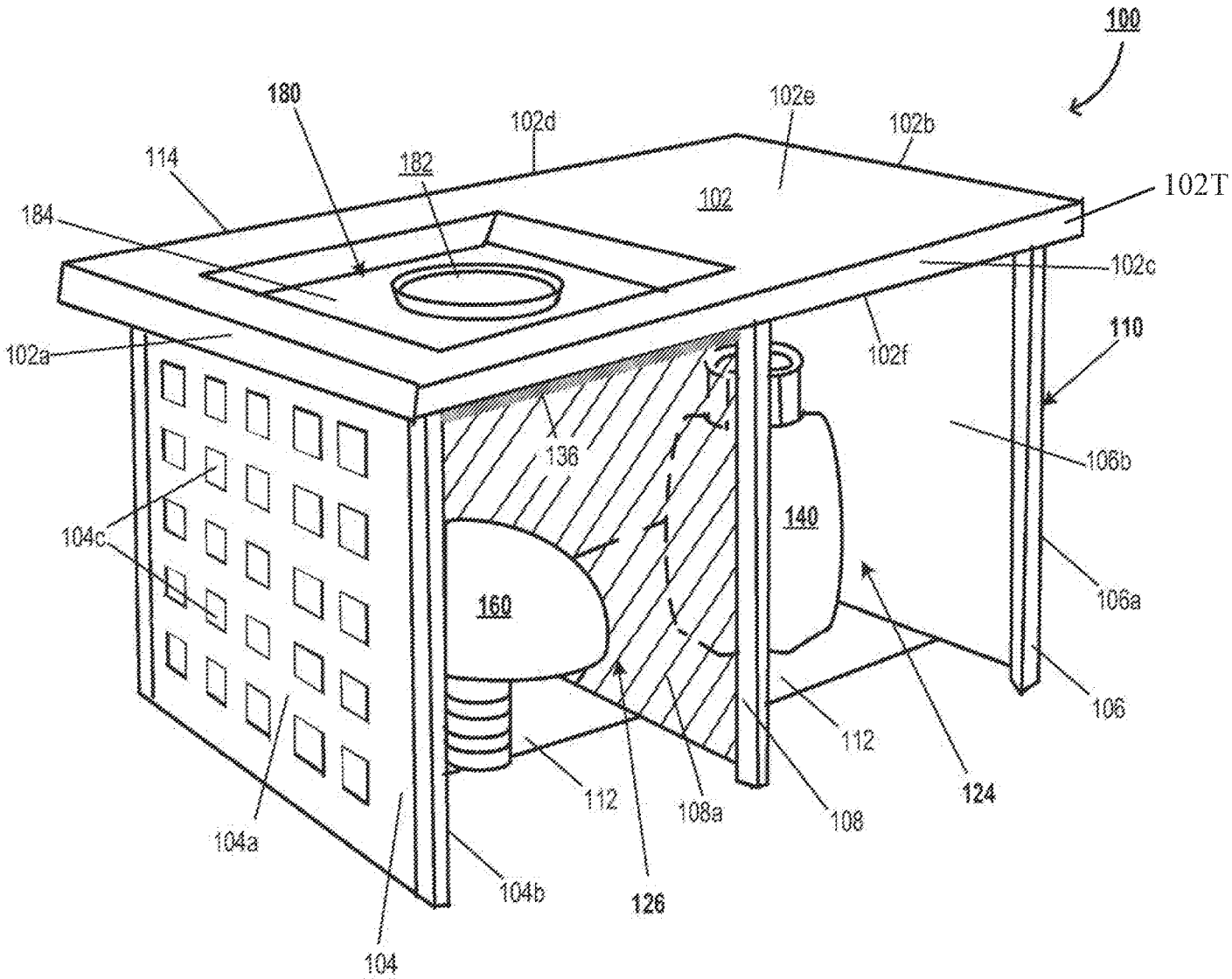
Figure 2:
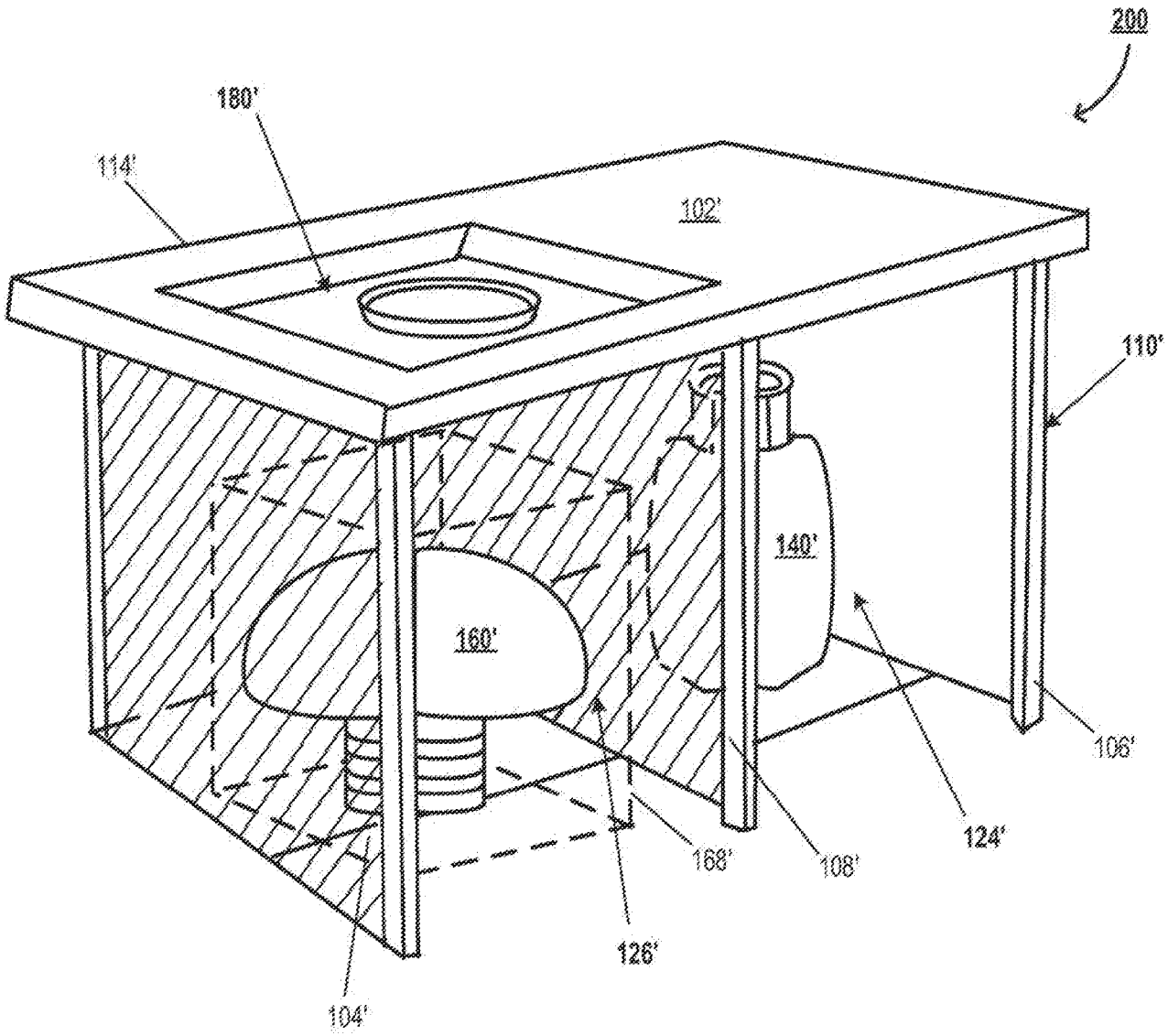
Figure 3:
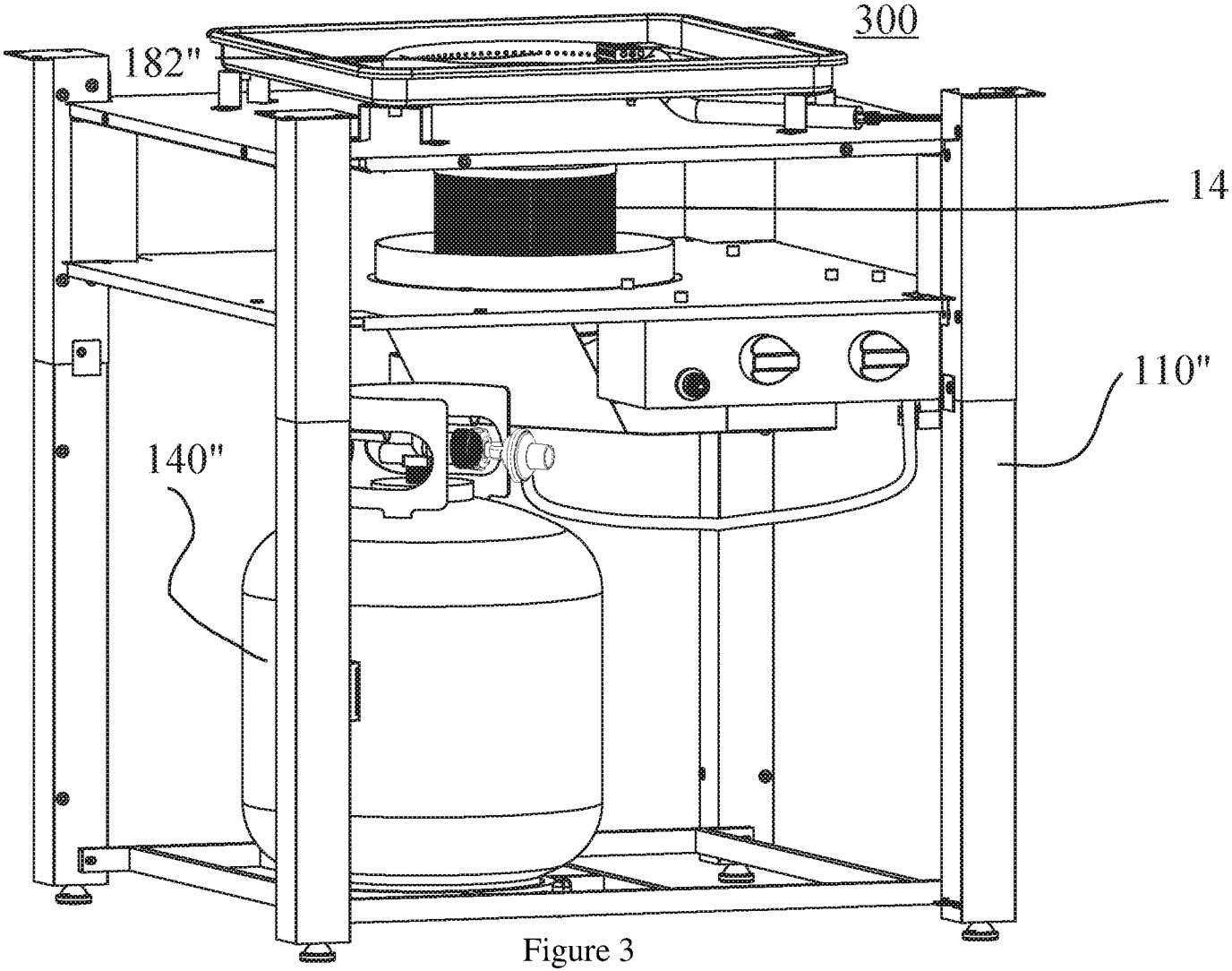
Figure 4:
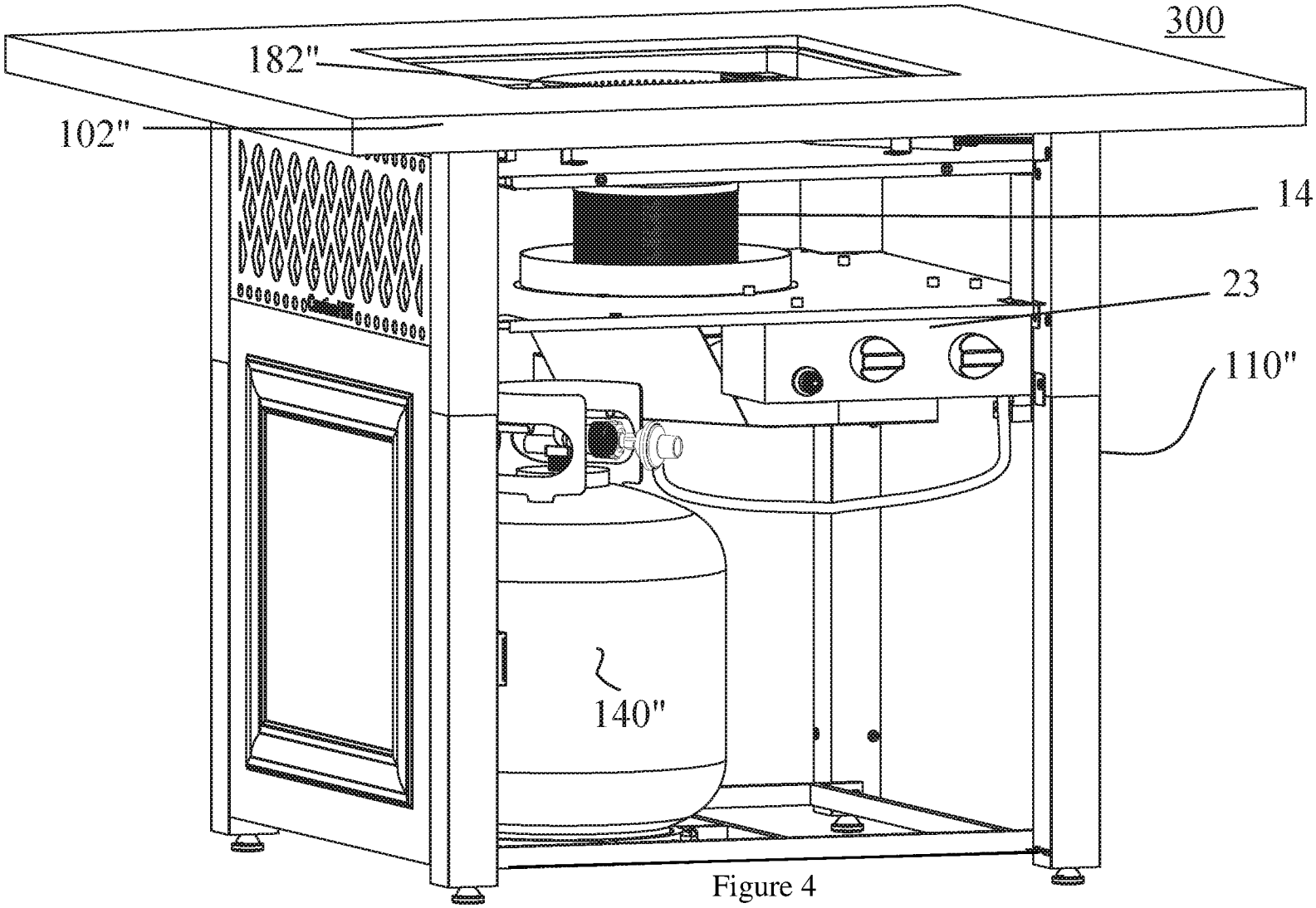

Having thus described embodiments of the disclosure in general terms, reference will now be made to the accompanying drawings, wherein:

FIG. 1 illustrates a perspective view of a multi-heat source apparatus, in accordance with some embodiments of the disclosure;

FIG. 2 illustrates a perspective view of an alternative embodiment of the multi-heat source apparatus of FIG. 1, in accordance to embodiments of the present disclosure;

FIG. 3 illustrates a perspective view of an alternative embodiment of the multi-heat source apparatus of FIG. 1 without lateral side members, in accordance to embodiments of the present disclosure;

FIG. 4 illustrates a perspective view of the multi-heat source apparatus of FIG. 3 including two lateral side members, in accordance to embodiments of the present disclosure;

FIG. 5-*a* illustrates an exploded view of the multi-heat source apparatus assembly of FIG. 3, in accordance to embodiments of the present disclosure; and FIG. 5-*b* illustrates a list of labels associated with FIG. 5-*a*, in accordance to embodiments of the present disclosure.

Some embodiments of the disclosure are herein described, by way of example only, with reference to the accompanying drawings. With specific reference to the drawings in detail, it is stressed that the particulars shown are by way of example and for purposes of illustrative discussion of the embodiments of the present disclosure only, and are presented in the cause of providing what is believed to be the most useful and readily understood description of the principles and conceptual aspects of the disclosure. The description taken with the drawings makes apparent to those skilled in the art how the various forms of the disclosure may be embodied in practice.

DETAILED DESCRIPTION

Embodiments of the present disclosure will now be described more fully hereinafter with reference to the accompanying drawings, in which some, but not all, embodiments of the disclosure are shown. Indeed, the disclosure may be embodied in many different forms and should not be construed as limited to the embodiments set forth herein; rather, these embodiments are provided so that this disclosure will satisfy applicable legal requirements. Like numbers refer to elements throughout. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein.

It will be appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. Certain features described in the context of various embodiments are not to be considered essential features of those embodiments, unless the embodiment is inoperative without those elements.

The present disclosure provides a novel fire pit that addresses the disadvantages of conventional fire pits described previously. Specifically, the fire pit of the present disclosure achieves effective and efficient heating of the surroundings using an infrared emitter, also referred to as an IR emitter, which converts electrical/chemical energy or heat from a combustion process to infrared radiation. Infrared waves, such as those transmitted by the infrared emitters, are electromagnetic waves with longer wavelengths (700 nm-1 mm), in comparison with visible light. Infrared waves transfer thermal energy by radiation heat transfer, via electromagnetic radiation, which does not require a medium for transfer of energy. Infrared radiation is configured to transfer heat at greater intensities/temperatures, with smaller losses of energy, with quicker response time, in comparison with conduction and convention heat transfers. Continuing with the previous example, the user in the vicinity of an IR emitter operating at a predetermined temperature would perceive heat at substantially the predetermined temperature, even though the surrounding air may be very cold (i.e., at a temperature lower than the predetermined temperature), since infrared radiation does not require a medium for propagation. Furthermore, IR emitters enable easy focusing of radiation to a particular area if desired. The present disclosure comprising a multi-heat source is configured to provide improved, holistic ambient heating in surrounding regions of the fire pit by creating both convection and radiation heat transfers, as described below. It is contemplated that, the present design may also be used with other fuel-burning and/or heating apparatuses, such as grills, insect traps, etc.

FIG. 1 illustrates a perspective view of a fire pit assembly 100, in accordance with some embodiments of the disclosure. Typically, the fire pit assembly 100 comprises a housing 110 configured to accommodate a fuel tank 140 (or another fuel source) and an infrared or IR emitter 160. The fire pit assembly 100 is configured to utilize energy sources/fuel, such as fuel provided by the fuel tank 140 (e.g. natural gas, propane, nitrogen), to provide ambient heating and/or lighting. The housing 110, typically comprises a first planar member (e.g., planar member 102) and lateral sides (e.g., lateral side members 104 and 106) that are arranged to form one or more compartments that are configured to at least partially enclose the fuel tank 140 and the IR emitter 160. As shown, the housing 110 has a first planar member 102 which has a rectangular shape, although the first planar member 102 may comprise any suitable shape, e.g., polygonal or curvilinear contour, with flat and/or curved surfaces. The first planar member 102 defines opposing first and second ends (102*a*, 102*b*), proximal end 102*c* and an opposing the proximal end 102*c* is a distal end 102*d*. As shown, 102*a*, 102*b*, 102*c* and 102*d* are sides with flat surfaces, the surfaces are perpendicular to an outer surface 102*e*. The first planar member 102 defines the outer surface 102*e* and an inner surface 102*f*, opposing the outer surface 102*e*. The first planar member 102 defines a thickness 102T (between the outer and inner surfaces (102*e*, 1021)). The housing further comprises opposing first and second lateral side members 104 and 106, each lateral side member being positioned proximate the inner surface 102*f*, and along the first and second lateral ends (102*a*, 102*b*) of the first planar member 102 respectively, as shown in FIG. 1. Furthermore, the first lateral side member 104 defines a first outer surface 104*a* facing the exterior, and an opposing first inner surface 104*b*. Similarly, the second lateral side member 106 defines a second outer surface 106*a* and an opposing second inner surface 106*b*. In some instances, the housing 110 further comprises a distal side member 114 (not illustrated) extending along the distal end 102*d* of the first planar member 102, and transversely between the first and second lateral side members (104, 106). In addition, in some embodiments, the housing 110 comprises a second planar member 112 positioned along ends of the first and second lateral side members (104, 106) that are opposite the first planar member 102. The first and second lateral side members (104, 106), and the first planar member 102, and optionally together with the distal side member 114 and the second planar member 112, define a main enclosure with a main interior volume.

Furthermore, the housing 110 comprises an intermediate partition member 108 (e.g., one or more partition members 108), positioned in the main enclosure between the first and second lateral side members (104, 106), such that the intermediate partition member 108 divides the main enclosure into a first compartment 124 and a second compartment 126. The intermediate partition member 108 typically is positioned proximate the inner surface 102*f*, extending transversely between the proximal end and distal end (102*c*, 102*d*) of the first planar member 102. The first compartment 124 defining a predetermined first volume is sized and dimensioned to receive the fuel tank 140. For instance, the first compartment 124 may be configured to house a standard 20 lb. propane cylinder or propane tank 140. The adjacent second compartment 126 defines a predetermined second volume and is sized and dimensioned to accommodate the IR emitter 160. In some embodiments, the housing 110 may further comprise a first proximal side member (not illustrated) extending between the intermediate partition member 108 and the second lateral side member 106 along the proximal end 102*c* of the first planar member 102, to enclose the first compartment 124. Similarly, the housing 110 may further comprise a second proximal side member (not illustrated) extending between the intermediate partition member 108 and the first lateral side member 104 along the proximal end 102*c* of the first planar member 102, to enclose the second compartment 126. As such, the housing 110, may suitably comprise one or more openings and doors for receiving the fuel tank 140 and the IR emitter 160 through them, for providing access to switches, tubing, controls and the like in the main enclosure.

As illustrated by FIG. 1, the housing 110 may further comprise a burner assembly or fire bowl assembly 180 located on the outer surface 102*e* of the first planar member 102, at least partially above the IR emitter 160, such that at least a portion of (e.g., the portion extending between the first lateral side member 104 and the intermediate partition member 108) the first planar member 102 shields the fire bowl assembly 180 from the IR emitter 160. For example, the portion extending between the first lateral side member 104 and the intermediate partition member 108*a* and/or the entirety of the first planar member 102 is structured as a first heat shield or a first shielding member as will be described in detail below. In other embodiments, the housing 110 may further comprise the burner assembly or fire bowl assembly 180 located on any suitable location on the housing 110.

Typically, the burner assembly 180 comprises a burner 182 and in embodiments, an ignitor (not shown) for igniting fuel from the fuel tank 140, some may also include a battery (not shown). The first planar member 102 (or another member) of the housing 110 is configured to receive and structurally support the burner assembly 180. In some embodiments, the first planar member 102 (or another member) comprises a depression 184 in which the burner assembly 180 is positioned. For instance, the ignitor may be of the piezoelectric type, but other types of ignitors may also be used. The burner 182 may further comprise a hollow tube or pipe including a plurality of burner ports configured to allow release of fuel for combustion to produce flames. The burner 182 can be constructed in any desired shape or configuration to create the desired fire effect or flame configuration, e.g., a straight tube or a ring. Typically, a fuel line (e.g., hose or piping or other inlet structures) is attached to the burner assembly 180 and extends to a distal end comprising a valve that can be attached to the fuel tank for delivering fuel from the fuel tank 140 to the burner for combustion. The fuel line may be suitably housed or accommodated by the first planar member 102, in some embodiments. The fuel tank 140 is a vessel which can be a typical propane tank encompassing propane gas while other fuel tanks may alternatively encompasses liquefied petroleum or other gaseous or fluid fuels. As shown, the fire pit apparatus 100 is configured to utilize natural or propane gas to fuel a contained fire generated by the burner assembly 140. Although, the fire pit apparatus 100 is designed primarily for outdoor use, such as in patio areas outside, but the design is also applicable to interior ventilated fireplaces and fire pits that use natural gas or propane as fuel. In addition, in some embodiments, the fire pit assembly is portable, and may comprise wheels and the like for ease of transport, while in other embodiments, the fire pit is configured to be stationary.

As discussed previously, the IR emitter 160 is configured to provide thermal radiation by generating electromagnetic infrared waves. Furthermore, the IR emitter does not require any contact or medium, such as air, between the IR emitter 160 and the region to be heated, for propagation of the infrared waves. The IR emitter 160 may be powered electrically by an electric power source or powered by fuel from the fuel tank 140. As such, the IR emitter 160 is configured to convert electrical energy from the electrical power source and/or chemical emitter comprises a filament that may be coiled, for example around a ceramic body, to provide a greater surface area. For example, the filament may be fabricated from tungsten (typically used in electrical IR emitter configurations and/or high temperature applications), carbon, alloys of iron, chromium, and aluminum (FeCrAl). In some embodiments, ceramic infrared heaters or emitters 160 are utilized with the emitter having a trough having concave face (e.g., a dome as illustrated), a flat face, and/or a bulb contour. In some embodiments, the IR emitter 160 is chosen from a group comprising electric powered emitters: heat lamps, ceramic infrared systems, far-infrared systems, quartz heat lamps, quartz tungsten infrared heaters, and the like, and/or from a group comprising gas-fired emitters: luminous or high intensity radiant heaters, radiant tune heaters and the like. Gas-fired IR emitters may utilize combustion products of the fuel from the fuel tank 140 to heat a steel emitter tube. In some embodiments, the IR emitter 160 comprises multiple infrared modules or emitter banks, which collectively provide the desired infrared radiation.

In some embodiments, the IR emitter 160 is chosen based on the desired infrared radiation characteristics. In some instances, a medium-wave and/or carbon (CIR) infrared heater or emitter 160, which typically emits infrared waves with wavelengths of 1400 nm and 3000 nm, is employed. These emitters are typically configured to operate at moderately high filament temperatures (for example, above 1000° C.) and moderately high power densities (for example, in the range of 60 to 150 kW/m2). In some embodiments, a near infrared (NIR) or short-wave infrared heater or emitter 160 is employed, with wavelengths in the range of 780 nm to 1400 nm. In some instances, the NIR emitters also provide some visible light. That said, it is also contemplated that in some instances, NIR emitters may be configured to operate at high filament temperatures (for example, above 1800° C.) and high power densities (for example, in the range of hundreds of kW/m2). In some embodiments, a far infrared emitter (FIR) 160 is employed, with the FIR emitter being configured to operate at infrared radiation wavelengths in the ranges above 3000 nm. As such, any combination of two or more types of emitters described herein may also be employed based requirements of the application, and one or more of them may be selectively turned on as desired during operation. In some instances, the temperature of the infrared radiation may be modified by causing the emitter to vary the wavelength of the wave and vice versa, the wavelength being inversely proportional to the temperature.

The structure and functioning of the fire pit apparatus will now be described more in detail. As such, the housing 110, and particularly one or more of the first and second lateral side members (104, 106), and the first planar member 102, the distal side member 114, intermediate partition member 108, the second planar member 112, and the proximal side members, may be constructed from any suitable material such as metals, alloys, ceramics (e.g., brick, cement, stone, or tile), plastics, composites, non-metals, wood or other materials, or a combination of the above. In this regard, the material is typically chosen based on the desired properties at the location of the housing 110, properties like strength, durability, thermal expansion, fire resistance, electrical resistance, infrared reflectivity, infrared absorption, magnetic properties, surface properties and the like. In embodiments, the material has low heat absorption and thermal conductivity. In other instances, the above listed properties may be achieved or augmented by use of coatings, coverings and other layers provided on the surface of the housing. In some embodiments, a fire-resistant material such as a suitable metal or ceramic, or a material with a fire-resistant coating, may be employed at the first planar member 102 in the vicinity of the burner assembly 140. The rest of the first planar member 102, for example, the portion above the fuel tank 140 may be constructed out of a heat insulating material. The various members of the housing 110 may be removably or permanently assembled using a suitable fastening structure such as welding, riveting, using complementary built-in coupling structures in the members (such as snap-fit couplings or interference fits), using screws, bolts, nuts or other fastening means, using glue and the like.

As discussed previously, the fire pit housing 110 comprises the first compartment 124 comprising the fuel tank 140, and the adjacent second compartment 126 comprising the IR emitter 160. The IR emitter may be secured within the second compartment using a suitable fastening structure such as welding, riveting, using complementary built-in coupling structures in the members (such as snap-fit couplings or interference fits), using screws, bolts, nuts or other fastening means, using glue and the like. To prevent the infrared radiation emitted from the IR emitter 160 from inadvertently heating up the fuel tank 140, associated components and the fuel contained therein, the present disclosure may provide one or more heat shields or shielding members to inhibit IR radiation emitted by the IR emitter from propagating therethrough. Each shielding member comprises a radiant barrier or reflective insulation that is configured to at least partially, substantially or completely shield, block, and generally inhibit radiation heat transfer from passing or propagating therethrough. In some embodiments, the heat shield/shielding member is constructed out of materials that are not conductors of IR radiation, and hence function as a radiant barrier. In some embodiments, the heat shield/shielding member is designed to inhibit propagation of IR radiation therethrough, and hence function as a radiant barrier. In some embodiments, each shielding member comprises a reflective coating at least on a surface facing the IR emitter 160, configured for reflecting the incident infrared radiation from the IR emitter 160 back into the second compartment. Typically, the reflective coatings or a reflective layer with high infrared reflectivity (or reflectance, for example, around 0.9 to 1 for inhibiting propagation and around 0.8-0.95, 0.7-0.85, and/or 0.6-0.75 for at least partially inhibiting propagation) and low emissivity (for example, around 0.1 or less) are employed. In addition to the high reflectivity and low emissivity properties, reflective coatings or layers having high oxidation resistance are utilized in some embodiments. In some embodiments, the reflective coatings or layer may comprise one or more layers or metalized films or laminate polyester films. Additional each shielding member may include one or more insulative layers behind the reflective coating or layer, such a fiberglass layer. In certain embodiments, the heat shields may be formed integrally with the distal side member 114, the second planar member 112, and/or intermediate partition member 108.

In one embodiment, the intermediate partition member 108, also referred to as a second heat shield 108 or second shielding member, is provided between the IR emitter 160 and the fuel tank 140. The second heat shield 108 comprises a radiant barrier or reflective insulation that is configured to at least partially, substantially or completely shield, block, and generally inhibit radiation heat transfer from passing or propagating therethrough. Specifically, the second heat shield is configured to shield the fuel tank from IR radiation emitted by the IR emitter. In some embodiments, the second heat shield 108 comprises a reflective coating at least on a surface 108*a* facing the IR emitter 160, configured for reflecting the incident infrared radiation from the IR emitter 160 back into the second compartment. Although described as being embodied in the intermediate portion member 108, in some instances, a separate second heat shield member or barrier, for example with a suitable reflective coating, may be attached to the intermediate portion member 108, to achieve insulation.

In addition, since the IR emitter 160 is placed directly beneath and/or proximate the burner assembly 180, heat shielding or radiant barriers are also provided on the first planar member 102 to prevent the infrared radiation from interfering with the open flame, the burner assembly itself, and any fuel in the intake manifold of the burner or inlet line. As such, as alluded to previously, a first shielding member is provided between the burner assembly and the second compartment, which is substantially similar to the second shielding member 108 described above. The first shielding member (and/or the second shielding member) is configured to at least partially, substantially or completely shield, block, and generally inhibit radiation heat transfer from passing or propagating therethrough. In this regard, the first shielding member refers to the first planar member 102, and particularly a reflective coated portion 136 of the inner surface 112*f* in the second compartment, facing the IR emitter 160. The reflective coatings, similar to those described above, are provided on at least the portion 136 of the first planar member configured for reflecting incident infrared radiation back into the second compartment. Although, in some embodiments, the first shielding member may be a separate member attached at the portion 136. That said, in some instances, the second heat shield and/or the intermediate partition member 108, and the first heat shield and/or the first planar member 102 are configured to additionally block conduction heat transfer.

Furthermore, the first lateral side members 104, the distal side member 114, and/or the opposite second proximal side member (not illustrated) extending between the intermediate partition member 108 and the first lateral side member 104, are configured to transmit therethrough, the incident infrared radiation for the IR emitter 160 to the outside/surroundings of the housing 110. In this regard, the first lateral side members 104, the distal side member 114, and/or the opposite second proximal side member may comprise one or more apertures (for example, apertures 104*c*) to facilitate the propagation of the infrared waves (for example, in first, second and third propagation directions respectively). In some embodiments, during usage the housing 110 is placed on the ground such that lateral side members are normal/vertical to the ground, the side 112 is proximate the ground. Here, the housing 110 is configured to enable propagation of infrared radiation to the surroundings along three directions across the first lateral side members 104, the distal side member 114, and the opposite second proximal side member, while the other three directions are insulated/shielded (heat shields (108, 102), and heat shield and/or ground insulation 112). In some embodiments, reflective coating may also be provided on interior surfaces of the member 112 inside the second compartment 126 to reflect waves back into the compartment and to reduce losses to the ground and/or protect flooring. Here, the member 112 is a third heat shield or a third shielding member.

The fire pit housing is structured to inhibit propagation of IR radiation from the IR emitter along first, second and/or third inhibiting directions, wherein the third inhibiting direction (across the member 112) is approximately 180 degrees relative to the first inhibiting direction (across the first shielding member at the first planar member 102), and the second inhibiting direction (across the second shielding member at intermediate partition member 108) is approximately 90 degrees relative to the first and third directions.

The present disclosure comprising a multi-heat source is configured to provide improved, holistic ambient heating both in surrounding regions of the fire pit by creating both convection and radiation heat transfers, as described below. As discussed, in some embodiments, the burner assembly or fire bowl assembly 180 having an open flame, fueled by the fuel from the fuel tank 140, provides convection heat transfer, via heat diffusion and bulk movement of the surrounding air, and/or conduction heat transfer thereby providing, substantially, a first ambient heating temperature to a user in a first surrounding region proximate the fire pit assembly 110. In some instances, the first ambient heating temperature may be a gradient that gradually decreases as a function of a linear distance from the fire pit assembly 110 in the first surrounding region. Here the first surrounding region may be a proximal surrounding region with respect to the fire pit assembly 110.

The IR emitter 160 emits infrared radiation that is structured to provide, substantially, a second ambient heating temperature to a user in a second surrounding region around the fire pit assembly 110. Here the second surrounding region may be a distal surrounding region with respect to the fire pit assembly 110 and the first surrounding region. In some instances, the first surrounding region is located between the fire pit assembly 110 and the second surrounding region, while in other instances the regions may be adjacent and/or may overlap partially or completely.

In some embodiments, the IR emitter 160 (and/or the infrared radiation emitted by the IR emitter) is structured such that a value of the second ambient temperature produced by the radiation from the IR emitter 160 at a predetermined location (e.g., a location in the second surrounding region) is greater than (or equal to) a value of the first ambient temperature produced by the convection and/or conduction heat transfer provided by the fire bowl assembly 180 at the predetermined location (e.g., the location in the second surrounding region). As discussed previously, the heating provided by convention heat transfer from fire bowl assembly 180 dwindles gradually as the distance from the fire pit assembly 110 increases. Here, the IR emitter may supplement or enhance the heating in the distal regions where the given convention heat transfer is insufficient to provide desired level of heating. That said, in some embodiments, the IR emitter 160 (and/or the infrared radiation emitted by the IR emitter) may also be structured such that the value of the second ambient temperature produced by the radiation from the IR emitter 160 at the predetermined location is lesser than the value of the first ambient temperature produced by the convection and/or conduction heat transfer provided by the fire bowl assembly 180 at the predetermined location.

The fire pit assembly 110 is structured to provide heating (e.g., at a predetermined temperature or a predetermined temperature range) both in the regions proximate to the assembly 110 (e.g., first surrounding region) and in the regions away from the assembly 110 (e.g., second surrounding region).

In one embodiment, a controller is provided (for example, on the fire pit 160 or on the housing 110) that allows the level of radiation from the IR emitter 160 and/or the size of the fire in the burner assembly 180 to be decreased or increased.

FIG. 2 illustrates a perspective view of a fire pit assembly 200, in accordance with another embodiment of the present disclosure. The features, structures and components of the fire pit assembly 200 are substantially similar to those described above vis-a-vis the fire pit assembly 100 illustrated in FIG. 1. As illustrated, the fire pit assembly 200 comprises a housing 110', which is configured to accommodate a fuel tank 140' (or another fuel source) and an infrared or IR emitter 160', substantially similar to those described previously. The housing 110, may comprise a first planar member (e.g., planar member 102') and lateral sides (e.g., lateral side members 104' and 106') that are arranged to form one or more compartments that are configured to at least partially enclose the fuel tank 140' and the IR emitter 160'. The housing may further comprise opposing first and/or second lateral side members 104' and 106'. In some instances, the housing 110 further comprises a distal side member 114' (not illustrated) extending along the distal end of the first planar member 102', and transversely between the first and second lateral side members (104', 106'). In instances, the housing 110 may further comprise a proximal side member (not illustrated) extending along a proximal end of the first planar member 102', and transversely between the first and second lateral side members (104', 106'), opposite to the distal side member 114'. The proximal side member may be similar to any of the members 102, 104, 108, 114, 106, and/or 112 described previously. In addition, in some embodiments, the housing 110' comprises a second planar member 112' positioned along ends of the first and second lateral side members (104', 106') that are opposite the first planar member 102. The first and second lateral side members (104', 106'), and the first planar member 102, and optionally together with the distal side member 114' and the second planar member 112', define a main enclosure with a main interior volume.

As discussed previously, the housing 110' may comprise an intermediate partition member 108' (e.g., one or more partition members 108'), positioned in the main enclosure between the first and second lateral side members (104', 106'), such that the intermediate partition member 108 divides the main enclosure into a first compartment 124' and a second compartment 126'. The intermediate partition member 108' typically extends transversely between the proximal end and distal end of the first planar member 102'. The first compartment 124' defining a predetermined first volume is structured to receive the fuel tank 140'. The adjacent second compartment 126' defines a predetermined second volume and is structured to accommodate the IR emitter 160'. As illustrated by FIG. 2, the housing 110' may further comprise a burner assembly or fire bowl assembly 180' located on the housing 110. Cut away or sectional views of the member 104' and 108' are illustrated in FIG. 2 to indicate the positions of the IR emitter 160' and the fuel tank 140', respectively.

As discussed previously, the IR emitter 160' is configured to provide thermal radiation by generating electromagnetic infrared waves. Furthermore, in some embodiments, the IR emitter 160' is a directional IR emitter 160'. In addition to or separately from the features described with respect to the IR emitter 160, the directional IR emitter 160' is structured to inhibit (partially or fully) the emission or propagation of IR radiation along at least one direction and/or inhibit (partially or fully) the emission or propagation of IR radiation in at least one linear or vector subspace. For example, in some embodiments, the directional IR emitter 160' is structured to inhibit IR radiation emitted by the IR emitter from propagating in a first direction extending towards the burner assembly 180'. In some embodiments, the directional IR emitter 160' is structured to inhibit IR radiation emitted by the IR emitter from propagating in a second direction extending towards the fuel tank 140' (e.g., in the first compartment). In some embodiments, the directional IR emitter 160' is structured to inhibit IR radiation emitted by the IR emitter from propagating in a third direction extending towards the ground, opposite to the first planar member 102'.

In some embodiments, the directional IR emitter 160' is structured to inhibit IR radiation emitted by the IR emitter from propagating in a single direction, for example, in the first direction towards the burner assembly 180', the second direction extending towards the fuel tank 140', the third direction opposite to the first planar member 102', or in another predetermined direction. In some embodiments, heat shields or shielding members described previously may be provided suitably on the housing if desired, for example, to inhibit the IR radiation in a direction in which propagation of IR radiation is not inhibited by the IR emitter 160' and/or the shielding members may be provided in any of the directions described above. For example, first, second and/or third shielding members described previously may be provided. In other embodiments, it is contemplated that the housing 110' does not comprise heat shields or shielding members. In some embodiments, it is contemplated that the housing 110' is structured as described previously, or alternatively, the housing 110' may comprise a single compartment without partitions, and/or without one or more of the members 104', 114', 108', 106' and/or 102'.

In some embodiments, the directional IR emitter 160' is structured to inhibit IR radiation emitted by the IR emitter from propagating in multiple directions, for example, in one of the first direction towards the burner assembly 180', the second direction extending towards the fuel tank 140', the third direction opposite to the first planar member 102', and/or in other predetermined directions. In some embodiments, heat shields or shielding members described previously may be provided suitably on the housing if desired in any suitable direction. For example, first, second or third shielding members described previously may be provided. In other embodiments, it is contemplated that the housing 110' does not comprise heat shields or shielding members. In some embodiments, it is contemplated that the housing 110' is structured as described previously, or alternatively, the housing 110' may comprise a single compartment without partitions, and/or without one or more of the members 104', 114', 108', 106' and/or 102'.

As discussed, the directional IR emitter 160' is structured to inhibit (partially or fully) the emission or propagation of IR radiation along at least one direction. In some embodiments, the components of the directional IR emitter 160', for example, the trough, dome, filament, and/or the like are structured such that inhibition of emission or propagation of IR radiation along at least one direction is achieved. For example, the dome of the IR emitter 160' is shaped or contoured (for example, in a half dome shape) or oriented (for example, oriented to face a particular direction opposite the inhibition direction) to inhibit propagation of IR radiation along at least one direction and/or focus the IR radiation in at least one predetermined heating directions.

In some embodiments, the directional IR emitter 160' comprises a shielding cover 168' (e.g., an external shielding cover) that is structured to inhibit (partially or fully) the emission or propagation of IR radiation along at least one direction. The shielding cover 168' is configured to at least partially cover or enclose the directional IR emitter 160'. For example, shielding cover 168' may enclose the directional IR emitter 160' in the at least one direction in which the inhibition of IR radiation is desired. Although, FIG. 2 illustrates the shielding cover 168' comprising polyhedron structure, the shielding cover 168' may comprise any suitable polygonal or curvilinear contour, with flat and/or curved surfaces. In some embodiments, the shielding cover 168' is similar to the heat shields and shielding members described previously. For example, the shielding cover 168' may comprise reflective coatings as described above or may be constructed out of materials that are not conductors of IR radiation.

FIGS. 3, 5-*a* and 5-*b* illustrate a perspective view of a multi-heat source apparatus 300, in accordance with another embodiment of the present disclosure. The features, structures and components of the multi-heat source apparatus 300 are substantially similar to those described above with respect to the fire pit assembly 100 illustrated in FIG. 1 with exceptions which are described hereinbelow. As illustrated, the multi-heat source apparatus 300 comprises a housing 110", which is configured to accommodate a fuel tank (e.g., fuel tank 140', fuel tank 140") which may include fuel such as natural gas, propane, or the like. The housing 110" includes a mantel or first planar member 102" disposed above a heat shield 7 and heat shield 9. Heat shields 7 and 9 are configured to selectively reduce or stop passing of heat, as shown heat shield 7 and heat shield 9 are in a sandwich configuration with a lower burner assembly 14 in between the two heat shields 7 and 9. Some embodiments, may further include a gas tank heat shield 20. As shown the gas tank heat shield 20 is connected to the lower heat shield 19 and a heat shield 15. The housing 110" may include at least one side members 104". The at least one side member 104" may include at least one opening or a plurality of small openings to allow propagation of heat from the apparatus. Embodiments shown include eight side members 104" two for each side of the multi-heat source apparatus which have a rectangular shape and include a plurality of small openings 104*p* although other numbers of side members and other shapes are also contemplated. Embodiments shown also include at least one lateral side member 104'" which have a quadrangular shape without any openings although other shapes are contemplated which may include any number of openings or holes.

The lower burner 14 of the fire pit assembly 300 is operably connected to a burner 182" and a control panel assembly 23. The control panel assembly 23 includes at least one control knob 22 and is connected to a regulator hose 24, while some embodiments may include a battery (not shown). The control panel assembly 23 may selectively enable heating of the lower burner 14 and/or the burner 182". In selected embodiments, the lower burner 14 may be replaced for an alternative heating element such as IR emitter 160 or 160'. As shown the lower burner 14 is configured to emit heat which is fueled by the fuel contained and encompassed by the fuel tank 140", Alternatively if the lower burner 14 is replaced by an alternative heating source (e,g, IR emitter 160 or 160', electric coil, convective heating element or convectional heating element) it is understood that such can be configured to emit heat which may be generated and dissipated via electric means.

The multi-heat source apparatus 300 may further includes a cover or table insert 2 which is configured to operably connect to the first planar member 102" to cover the burner 182" and a cover or door 36 which is configured to enclose the multi-heat source 300 to form a fully enclosed multi-heat source fire-pit assembly.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the Plain-English equivalents of the respective terms "comprising" and "wherein." Moreover, in the following claims, the terms "first," "second," and "third," etc. are used merely as labels, and are not intended to impose numerical requirements on their objects.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present disclosure.

While certain exemplary embodiments have been described and shown in the accompanying drawings, it is to be understood that such embodiments are merely illustrative of, and not restrictive on, the broad disclosure, and that this disclosure need not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the disclosure. Therefore, it is to be understood that, within the scope of the appended claims, the disclosure may be practiced other than as specifically described herein.

What is claimed is:

1. A multi-heat source fire pit apparatus comprising:

a fire pit housing comprising a top member with side members forming at least one compartment;

a first heat source configured to produce ambient heating positioned in or proximate the at least one compartment;

a second heat source positioned within the top member and directly above the first heat source; and a first shielding member configured to at least partially shield heat emanating from the first heat source towards the second heat source, wherein the side members include one or more openings configured to allow propagation of the ambient heating emitted from the first heat source.

2. The multi-heat source fire pit apparatus according to claim 1, wherein the side members extend vertically from the top member, the top member defining opposing first and second lateral ends in a first direction and a proximal end and an opposing distal end in a direction transverse to the first direction, the top member with side members forming the at least one.

3. The multi-heat source fire pit apparatus according to claim 2, wherein the second heat source is a burner assembly and configured to produce an open flame by combusting fuel received from a fuel source.

4. The multi-heat source fire pit apparatus of claim 3, wherein the burner assembly provides convection heat transfer and/or conduction heat transfer.

5. The multi-heat source fire pit apparatus according to claim 2, wherein the first heat source is an infrared (IR) emitter positioned in the at least one compartment.

6. The multi-heat source fire pit apparatus of claim 5, wherein the IR emitter is configured to convert electrical energy into IR radiation.

7. The multi-heat source fire pit apparatus of claim 5, wherein the IR emitter is configured to convert energy from fuel in a fuel source into IR radiation.

8. The multi-heat source fire pit apparatus according to claim 1, wherein the side members are positioned proximate the first heat source.

9. The multi-heat source fire pit apparatus of claim 1, wherein the first shielding member comprises a reflective coating on a surface proximate to the first heat source, and Wherein the reflective coating is structured to reflect incident radiation from the first heat source into a fuel source.

10. The multi-heat source fire pit apparatus of claim 1, wherein:

the first heat source is structured to produce a first ambient temperature at a predetermined location at a first distance away from the multi-heat source fire pit apparatus; and the first ambient temperature is greater than or equal to a second ambient temperature produced by convection heat transfer from the second heat source at the predetermined location.

11. The multi-heat source fire pit apparatus of claim 1, wherein the first heat source comprises a filament and a concave trough.

12. The multi-heat source fire pit apparatus of claim 1, wherein the fire pit housing is configured to inhibit propagation of heat from the first heat source along first, second and third inhibiting directions, wherein the third inhibiting direction is approximately 180 degrees relative to the first inhibiting direction and the second inhibiting direction is approximately 90 degrees relative to the first and third inhibiting directions.

13. The multi-heat source fire pit apparatus of claim 1, wherein the fire pit housing comprises a second shielding member between the first heat source and a fuel source, wherein the second shielding member is configured to inhibit heat emitted by the first heat source from propagating therethrough.

14. The multi-heat source fire pit apparatus of claim 13, wherein the fire pit housing comprises a third shielding member that is arranged opposite the first shielding member, and wherein the third shielding member is structured to inhibit heat emitted by the first heat source from propagating therethrough.

15. A fire pit apparatus comprising:

a fire pit housing comprising a top member having side members configured to form at least one compartment configured to receive a heat source;

a first heat source configured to produce ambient heating and positioned in or proximate the at least one compartment;

a second heat source positioned on the fire pit housing and directly above the first heat source and configured to produce heat from a fuel source; and a first shielding member configured to at least partially shield heat emanating from the first heat source towards the second heat source, wherein the side members are positioned proximate at least the first heat source, and wherein the side members include one or more openings structured to allow propagation of heat emitted from the first heat source.

16. A multi-heat source fire pit apparatus comprising:

a fire pit housing comprising a top surface having side members to form a storage area configured to receive a heat source;

a first heat source configured to produce ambient heating and positioned in or proximate the storage area and configured to emit heat or radiation;

a second heat source positioned directly above the storage area and the first heat source and configured to produce heat by fuel received from a fuel source; and a first shielding member configured to at least partially shield heat emanating from the first heat source towards the second heat source, wherein the side members are positioned proximate the first heat source, and wherein the side members include one or more openings structured to allow propagation of heat emitted from the first heat source.

17. A multi-heat source apparatus comprising:

a housing configured to form a first compartment and a second compartment, wherein the first compartment is configured to receive a fuel source and the second compartment is configured to receive a first heat source configured to produce ambient heating;

a second heat source positioned on the housing and directly above the first heat source configured to produce heat by fuel received from the fuel source; and a first shielding member configured to at least partially shield heat emanating from the first heat source towards the second heat source, wherein the housing includes one or more openings structured to allow propagation of heat emitted from the first heat source.

18. The multi-heat source apparatus according to claim 17, wherein the first heat source is an infrared (IR) emitter positioned in the first compartment.

19. The multi-heat source apparatus according to claim 17, wherein the second heat source is a burner assembly and configured to produce an open flame by combusting fuel received from the fuel source.

* * * * *